United States Patent [19]

Stiles

[11] Patent Number: 4,719,858

[45] Date of Patent: Jan. 19, 1988

[54] EXPLOSIVE BAND SEPARATION DEVICE

[75] Inventor: Edward H. Stiles, San Diego, Calif.

[73] Assignee: The United States of America as represented by the Secretary of the Navy, Washington, D.C.

[21] Appl. No.: 911,274

[22] Filed: Sep. 22, 1986

[51] Int. Cl.[4] ..... F42B 15/10

[52] U.S. Cl. ..... 102/378

[58] Field of Search ..... 102/377, 378; 24/483, 24/484; 60/225

[56] References Cited

U.S. PATENT DOCUMENTS

| | | | |
|---|---|---|---|
| 2,967,482 | 1/1961 | Toomey, Jr. | 102/377 |
| 3,404,649 | 10/1968 | Valihora | 102/378 |
| 3,458,217 | 7/1969 | Pride, Jr. et al. | 102/378 |
| 3,633,456 | 1/1972 | Carr | 102/378 X |
| 3,903,803 | 9/1975 | Losey | 102/378 |
| 4,002,120 | 1/1977 | Swales et al. | 102/378 |
| 4,106,875 | 8/1978 | Jewett | 102/378 |
| 4,314,500 | 2/1982 | Hoppe | 102/378 |
| 4,628,821 | 12/1986 | Madderra et al. | 102/377 X |

*Primary Examiner*—Ted L. Parr

*Attorney, Agent, or Firm*—Ervin F. Johnston; Thomas Glenn Keough

[57] ABSTRACT

Successive stages of a missile are held together by an encircling band joined at its ends by an explosive band separation device. Opposite ends of the band are welded to separable parts which interlock with each other. Since the band is held in tension, inclined surfaces on the separable parts force them from maintaining an engagement so that a retaining cover is needed to hold them together. The retaining cover is held by a pair of balls which diametrically communicate with a longitudinal bore. A piston in the bore keeps the balls in cavities in the retaining cover to hold the separable parts together. A power cartridge detonated by an electrical signal displaces the piston the length of the bore and the balls free of the retaining cover. The retaining cover rotates by a resultant upward force exerted by the inclining surfaces. Freed from the retaining cover the tensile force exerted by the band pulls the separable parts apart to free successive stages of the missile from one another. An insert or safety pin is included to hold the piston in place in the bore prior to detonation of the power cartridge so that the shock and vibration normally attendant a missile launch do not disrupt the interface between the missile stages. When the cartridge detonates, the insert pin is sheared by the piston to assure a responsive release of the encircling band.

10 Claims, 9 Drawing Figures

EXPLOSIVE BAND SEPARATION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Explosive bolt or band cutters for inflight missile staging are well known for their timely separation of one stage from another within the flight envelope. As higher performances levels are reached however, higher loading requirements and design specifications for vertical launch impose the need for more capable separators. Modifications of the airframe with respect to overall diameter and payload limit the interior space heretofore set aside for an internally located conventional explosive band cutter. While lower performance missiles have permitted the separation bands, the band end-fittings and tension bolt to be fully exposed to the aerodynamic slipstream, the advent of vertical launch, high performance missiles require drag reduction by fairing all exterior devices. These require that the explosive band separation device present a minimum cross-sectional area to aerodynamic flow to further reduce drag and enhance missile performance while having a high degree of reliability. They must have all this without exposing personnel to undue hazards during missile assembly and disassembly.

Thus a need exists in the state-of-the-art for a reliable yet safe explosive band separation device which accommodates itself to aerodynamic considerations attendant for vertical launch, high performance missiles.

SUMMARY OF THE INVENTION

The present invention is directed to providing an inflight actuated explosive device for separating a pretensioned band holding successive stages of a missile together. Means secured to one end of the pretensioned band provide at least one lug member having an inclined surface. Means is secured to the other end of the pretensioned band for retaining the lug member in a retaining recess that has an inclined wall configured to accommodate the inclined surface of the lug. The inclined surface and the inclined wall mechanically cooperate to produce a resultant force on and displacement of the lug from the retaining means. A means having a pair of coneshaped cavities and carried on the providing means and the retaining means for holding the lug in the retaining means prevents the displacement of the lug from the retaining recess. A means is coupled to the cavities of the holding means for releasably securing the holding means on the providing means and the retaining means by the divergent displacement thereof. A further means is disposed in the retaining means for initiating a convergent displacement of the releasably securing means to release the holding means that enables the resultant force to push the holding means away and the consequent displacement of the lug and release of the pretensioned band.

A prime object of the invention is to provide for improved explosive disconnect holding a pretensioned band that secured successive missile stages.

Another object is to provide for the release of a pretensioned band that reduces a hazardous exposure of personnel.

Yet another object is to provide for a pretensioned band release that has a small frontal profile that can be easily faired for drag reduction.

Still another object is to provide for a separation device easily assembled and installed without undue exposure to the hazards associated with explosive devices.

Still yet another object is to provide for an explosive band separation device having a locking insert or safety pin to avoid premature release during the shock and vibration attendant to missile ground handling, shipping, launch and during flight.

A further object is to provide a band release that includes a band pretensioning bolt for reliable missile assembly and in-flight separation.

These and other objects of the invention will become more readily apparent from the ensuing specification taken with the included drawings in conjunction with the appended claims.

DESCRIPTION OF THE PREFERRED EMBODIMENT

Figure 1:
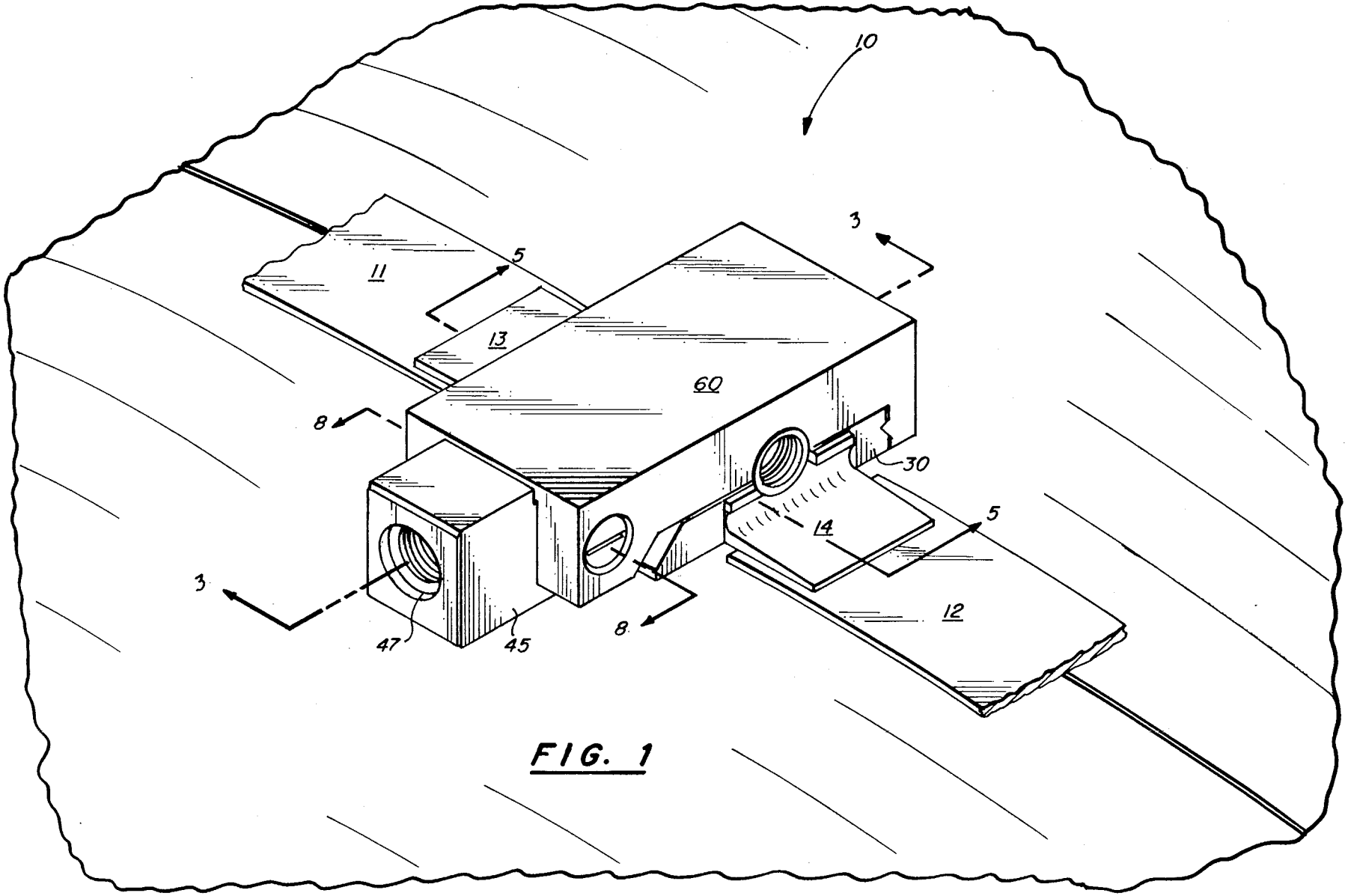
FIG. 1 is an isometric depiction of the invention holding a pretensioned band that joins successive stages of a missile.

Referring now to FIG. 1 of the drawings, an explosive band separation device 10 secures the opposite ends 11 and 12 of a high tensile strength band. A pair of extensions 13 and 14 of the device are welded to the opposite ends. The band encircles two successive stages 15 and 16 of a missile and may hold the successive stages together merely by a strong radially inwardly compressive force alone or may hold spring biased interlocking elements of the two stages. The exact joining features of the stages are not critical for an understanding of this inventive concept since compressive bands have been used to hold successive stages together in a number of manners well known to those versed in this particular art.

Figure 2:
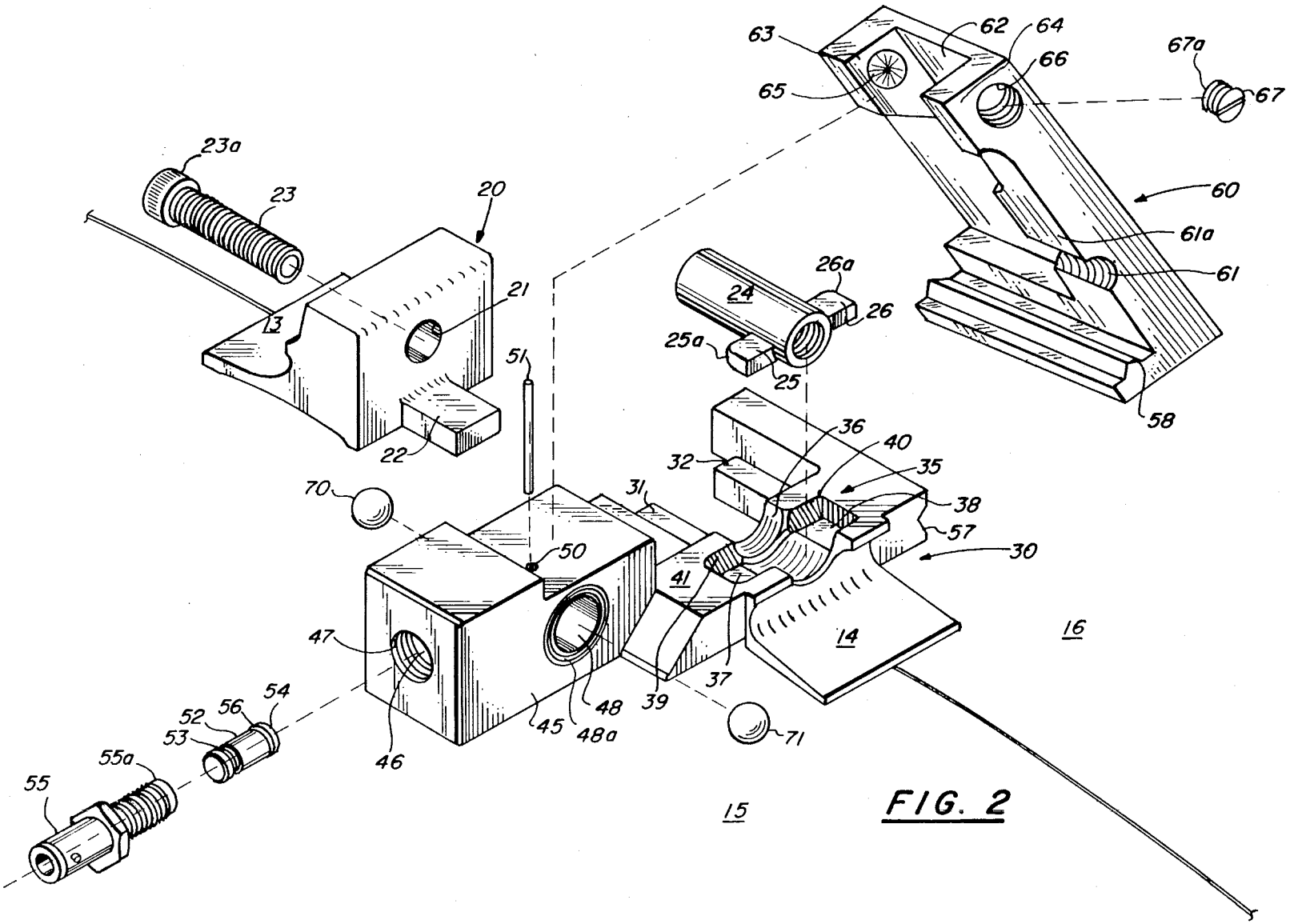
FIG. 2 is an exploded view of the invention with the pretensioned band removed for clarity.

Extension 13 is an integral extension from a connector block 20 that is provided with a bore 21 and an integrally extending tongue 22, see FIG. 2. A threaded tensioning bolt 23 is sized to permit free passsage through the bore until bolt head 23a abuts the connector block. Head 23a is appropriately shaped with a slot or hex socket head to permit selective tensioning of the band by rotating the bolt. Bore 21 is sufficiently sized to allow a degree of rotation when the separation device separates.

A lug connector member 24 is provided with a threaded bore configured to mate with threaded bolt 23 so that by turning the bolt the relative longitudinal extension of the connector member can be precisely adjusted and the tensioning of the band may be changed. A pair of oppositely extending lugs 25 and 26 are provided on connector member and each have approximately 25° tapered lug faces or surfaces 25a and 26a that assure the proper mechanical coaction of the separation device in a manner to be explained in greater detail.

Extension 14 integrally extends from a machined actuator base 30. The actuator base and connector block are machined from a material having sufficient strength, corrosion resistance and other properties for enabling precise machining operations. Stainless steel has been found to be acceptable although it is recognized that a wide variety of suitable space age equivalent materials are available in the state-of-the-art. The actuator base is machined to accommodate connector block 20 and has a pair of shoulders 31 and 32 spaced apart to receive tongue 22 of the connector block and to prevent lateral misalignment. A retaining recess 35 has a cylindrical portion 36 and a pair of lateral retaining recesses 37 and 38 for accommodating lug connector member 24. Inclined walls 39 and 40 are provided in lateral retaining recesses 37 and 38 respectively and have substantially the same taper or angle of inclination, about 25°, as do tapered surfaces 25a and 26a on lugs 25 and 26. The dimensions of retaining recess 35 and lug connector member 24 are such that when the lug connector member is placed within the retaining recess the upper surfaces of lugs 25 and 26 are essentially coplanar with an upper surface 41 of actuator base 30.

Figure 3:
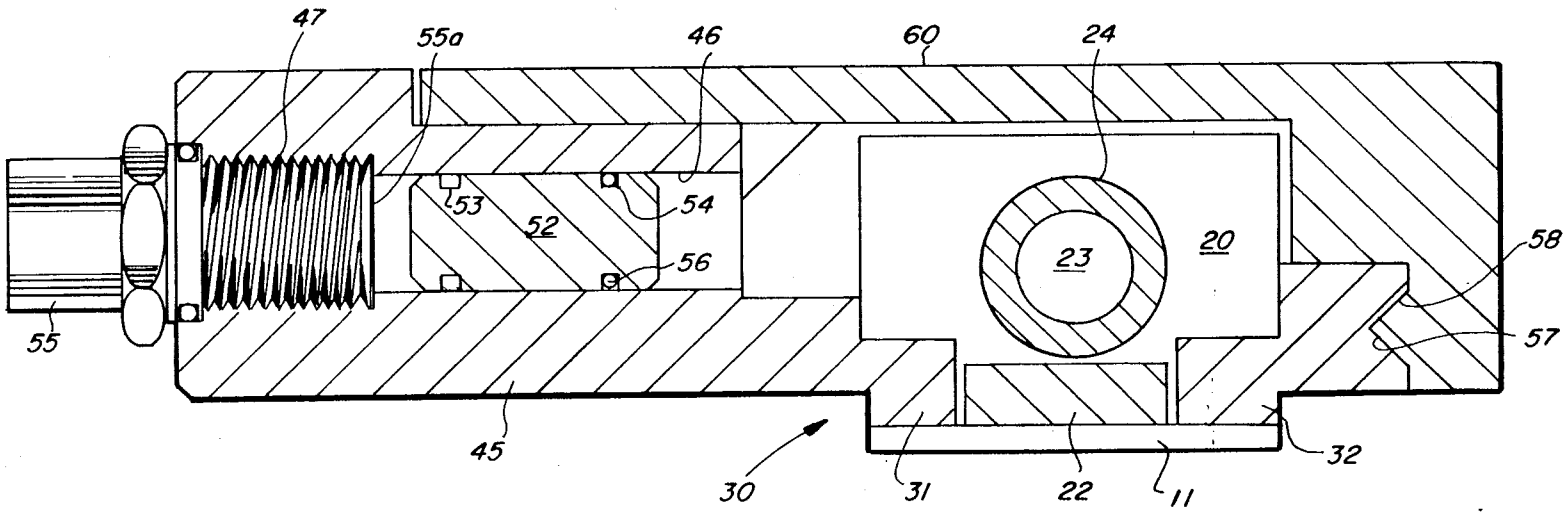
FIG. 3 is a cross-sectional view taken along lines 3—3 in FIG. 1 in which the piston is held in a first safety position.

Actuator base 30 is provided with an integral actuator base portion 45 that is shaped with a longitudinal bore 46, see FIG. 3. A threaded section 57 is machined at one end of the bore and has a slightly larger dimension than the rest of the bore to accommodate an explosive cartridge unit 55. A pair of holes 48 and 49 with O-rings 48a and 49a (FIGS. 2 and 8) laterally extend from opposite sides of the bore while a retainer pin hole 50 is drilled from top to bottom of the actuator base portion. This hole frictionally holds a retainer pin 51 that extends through a portion of the longitudinal bore.

Figure 8:
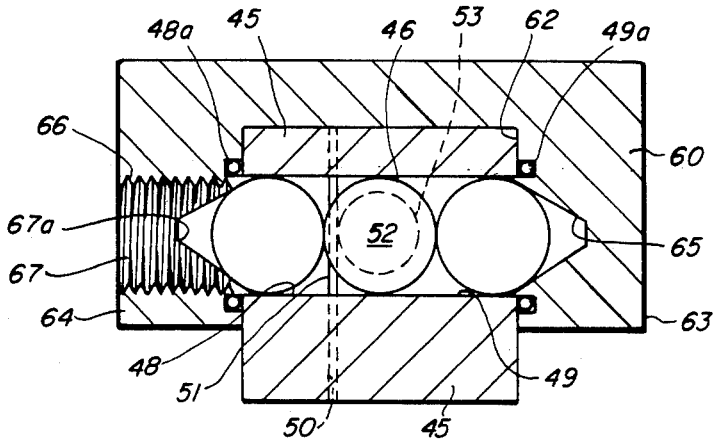
FIG. 8 shows the balls releasably securing the cover with the piston in the first position taken along lines 8—8 in FIG. 1.

Retainer, pin 51, see FIG. 8, arrests longitudinal motion of an appropriately sized piston 52 through longitudinal bore 46. The piston is provided with annular grooves 53 and 54. Groove 53 is aligned with retainer pin hole 50 when piston 52 is located in a first safety position within longitudinal bore 46. Inserting a retainer pin 51 through the aligned retainer pin hole and portion of annular groove 53 will arrest motion of the piston in the actuator base portion during the early part of the missile launch when the missile is subjected to shock and vibration.

Figure 4:
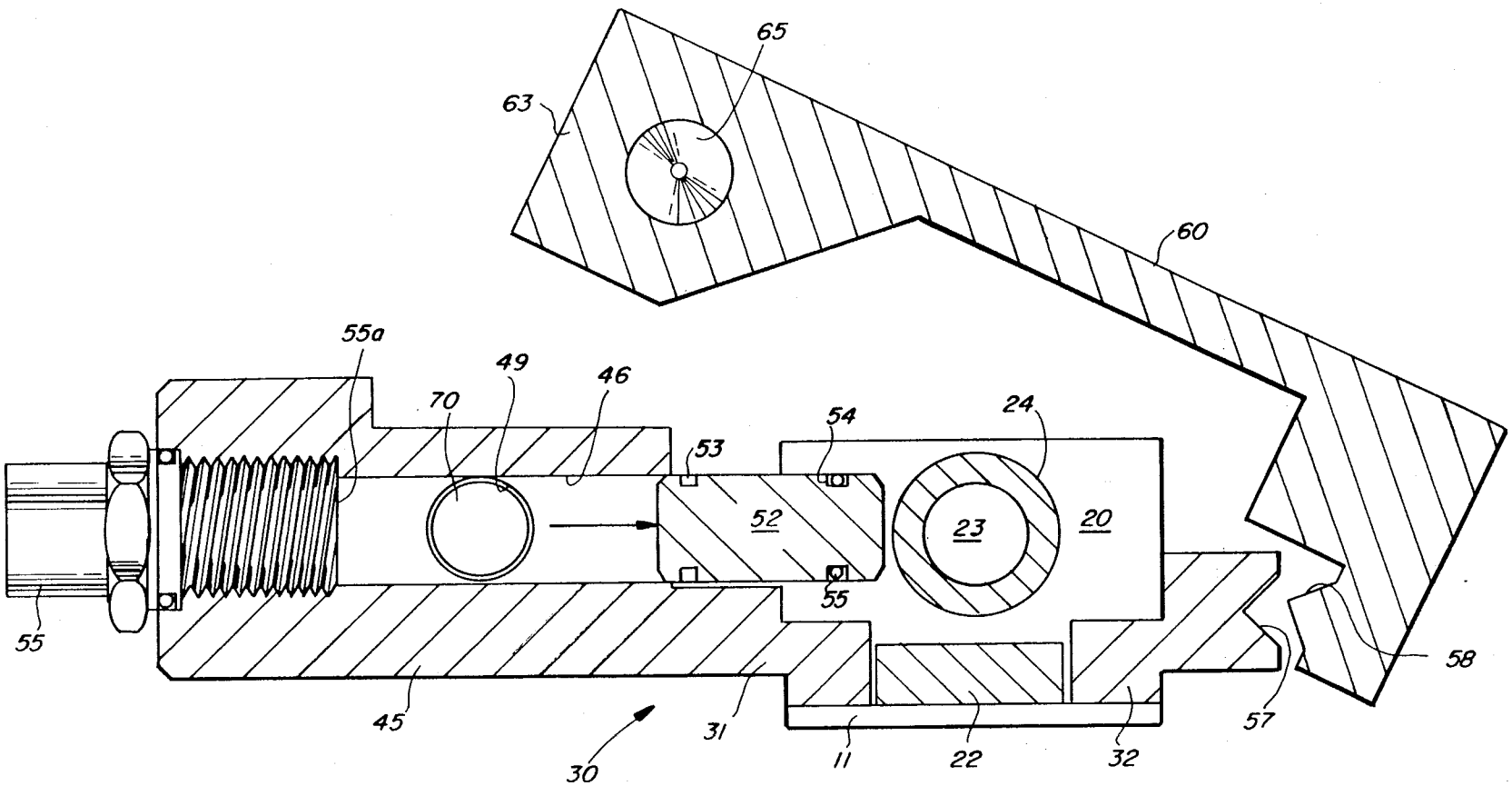
FIG. 4 is a cross-section of the invention showing the piston displaced to a second position after detonation of the power cartridge.

The material of the retainer pin is plastic, cooper or the like which will shear when explosive cartridge unit 55 is detonated. Detonation of the explosive cartridge unit is accomplished by electrical means at some predetermined time when it is desired to separate successive stages 15 and 16. After the explosive cartridge unit is threaded in section 47 and detonation occurs, the explosive blast coming out at 55a pushes against piston 52 to shear retainer pin 51. An O-ring 56 carried in annular groove 54 in the piston prevents gas bypass of the piston and assures that the piston travels away from explosive cartridge, longitudinally down longitudinal bore 46 to a second position as depicted in FIG. 4. O-ring 56 in addition to help assure longitudinal travel of the piston to the longitudinal bore, also prevents moisture from coming into the bore that might introduce corrosion or other elements that affect reliability (O-rings 48a and 49a also help in this regard).

The opposite end of actuator base portion 45 is provided with a lateral V-shaped groove 57. The groove functions as an elongate fulcrum for a mating longitudinal Vshaped ridge 58 shaped on a retaining cover 60, see FIGS. 2, 3 and 4.

The retaining cover is a machined block of material similar to that chosen for connector block 20 and actuator base 30. A lateral semi-cylindrically shaped recess 61 accommodates the circumference of lug connector member 24. A flat surface 61a is shaped to contiguously abut flat surface 41 on actuator base 30. A U-shaped channel 62 is machined in the retaining cover and slidably fits about integral actuator base portion 45. A pair of retaining cover depending portions 63 and 64 reach around the sides of the base portion 45 and a cone shaped recess 65 is provided in one depending portion and the threaded bore 66 is provided in the other depending portion. A threaded plug 67 screws into the threaded bore and has a cone shaped face or recess 67a configuration similar to cone shaped recess 65.

A pair of spherical stainless bearings 70 and 71 are positioned in holes 49 and 48 of actuator base portion 45. When retaining cover 60 is located to place its lateral V-shaped projection 58 resting in V-shaped groove 57 and surface 61a abuts surface 41, lug connector member 24 is held in actuator base 30 and the two spheres or balls partially occupy the volume within cone shaped cavities 65 and 67a in the retaining cover 60. Piston 52 is positioned to a first position in longitudinal bore 46 to hold balls 70 and 71 within cavities 65 and 67a. This interlocks retaining cover 60 to actuator base portion 45 that integrally extends with actuator base 30, see FIGS. 3 and 8. Retaining pin 51 extending through retainer pin hole 50 and a portion of groove 53 in piston 52 holds the piston in a first position in longitudinal bore 46.

Since ends 11 and 12 of the encircling band have been welded to extensions 13 and 14 of the band separation device, the tension exerted by band portions 11 and 11 tends to urge lug connector member 24 out of its engagement in actuator base 30. However, since retaining cover 60 securely holds lug connector member with its lugs 25 and 26 in lateral retaining recesses 37 and 38, separation of the band separation device is prevented. Proper tensioning by rotating threaded bolt 23 can be made to further assure that the proper tensile stress for responsive actuation of the band separation device is present.

Responsive operation of the explosive band separation device is initialed after an explosive cartridge unit 55 is threaded into section 47 and the electrical interconnections from the explosive cartridge unit are made. This feature is for added safety since it reduces the exposure to personnel of the potentially harmful explosive device.

Figure 9:
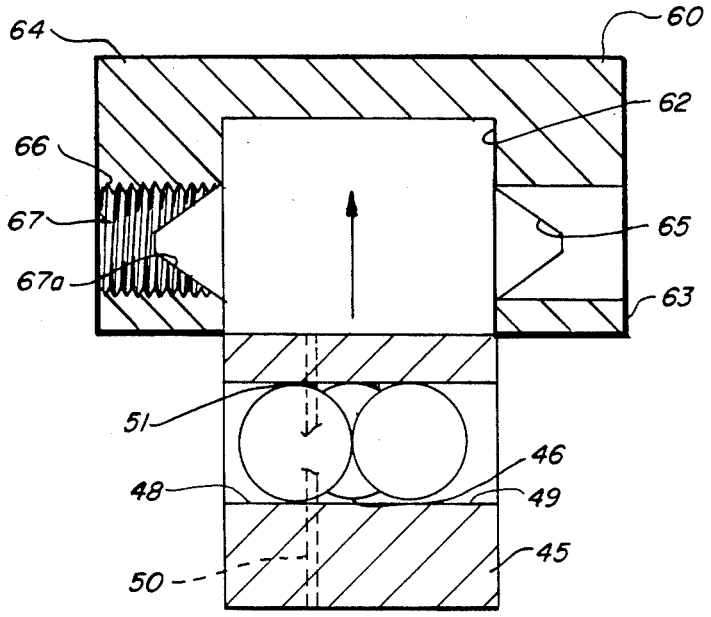
FIG. 9 shows the balls retracted and out of releasable engagement with the cover and the piston in the second position.

Launching of the missile with the attendant shock and vibration fails to dislodge piston 52 since retainer pin 51 securely holds it in place. At the predetermined time when separation between successive stages 15 and 16 is to occur, explosive cartridge member 55 is detonated by a proper signal. The gases from explosive cartridge bear against piston 52 and shear retainer pin 51. Piston 52 moves from its first positon, note FIGS. 3 and 8, to a second position, note FIG. 4, as it longitudinally travels thorugh longitudinal bore 46. Balls 70 and 71 are free and roll in a converging direction into longitudinal bore 46, see FIG. 9.

Figure 5:
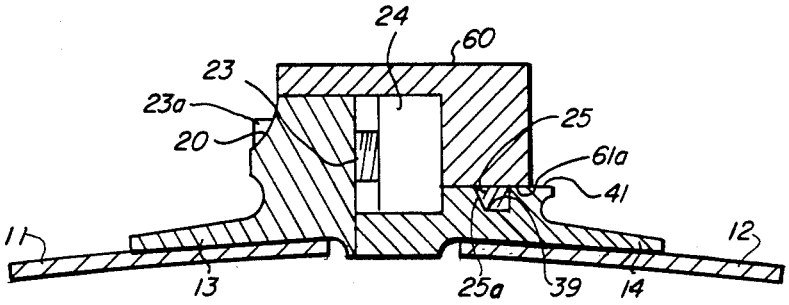
FIG. 5 is a cross-sectional view taken generally along lines 5—5 in FIG. 1 prior to release of the pretensioned band.

Force for urging the balls into the bore is provided by the camming action of the inclined surfaces of cone shaped cavity 65 and cone shaped cavity 67*a*. These inclined surfaces exert a result force on the balls forcing them into bores 48 and 49. The force is transmitted to these cavities from the upward force exerted by the upper surface of lug connector member 24 pushing upwardly against the inner surface of semicircular recess 61 on retaining cover 60 and surface 61*a* by lugs 25 and 26, see FIG. 5.

Constituents for creating an upward force include tapered or inclined surfaces 25*a* and 26*a* of lugs 25 and 26 of the lug connector member 24 (they have an approximate 25° taper). Surfaces 25*a* and 26*a* together with mating tapers or inclined surfaces on inclined walls 39 and 40 of lateral retaining recesses 37 and 38 of retaining recess 35 create a normal or upward separation force that tends to force lug connector upward. This upward separation force rotates retaining cover 60 about the longitudinal joint created between V-shaped groove 57 and the mating V-shaped projection 58 of the retaining cover to raise depending portions 63 and 64 of the retaining cover. As the depending portions are raised, the cone shaped cavities 65 and 67*a* push balls converging inwardly into longitudinal bore 46.

Figure 6:
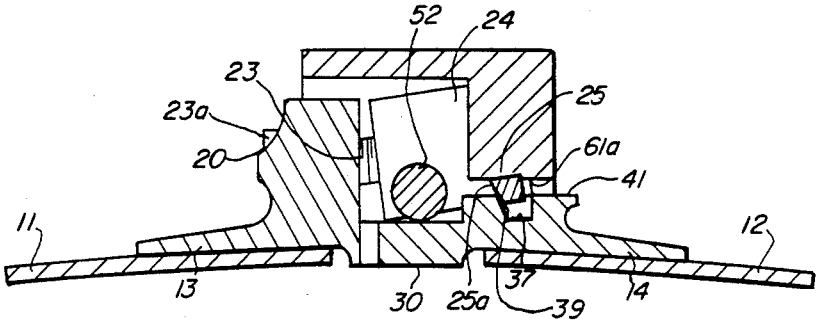
FIG. 6 is a cross-sectional view showing a partial release of the pretensioned band.
Figure 7:
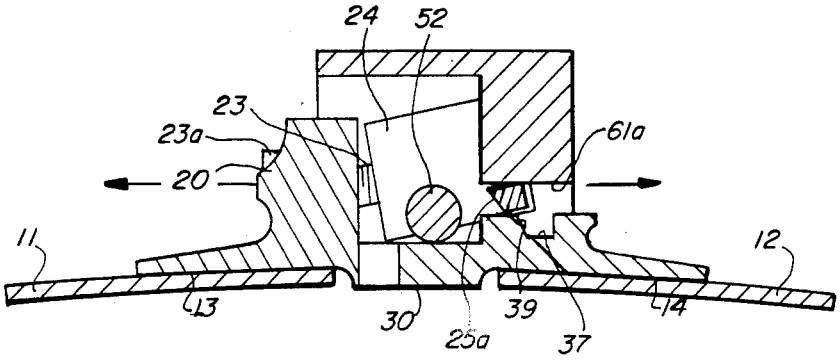
FIG. 7 is yet a further cross-sectional depiction of a further stage of release of the pretensioned band.

As this occurs, lugs 25 and 26 of lug connector member 24 begin to ride upwardly on inclined walls 39 and 40 of retaining recess 35, see FIG. 6. The upward force exerted by lug connector member 24 on retaining cover 60 is approximately 41.5 per cent of the band pretensioned load. This load disassembles retaining cover 60 from actuator base 30 and allows still further upward travel of lug connector member 24. Since hole 21 is sufficiently large to accommodate some pivotal motion by bolt 23, lug connector member 24 will pivot slightly as it disengages retaining recess 35 to allow connector block 20 to be pulled free from actuator base 30, see FIG. 7. This completely releases the band pretension load and the band and band separation device is pulled free to allow separation of successive stages 15 and 16.

A band separation device such as described has a small frontal profile and can be easily faired for drag reduction. As the separation device is assembled on a missile, personnel are not exposed to the hazards attendant the handling of explosives. The explosive cartridge member is inserted long after all other constituents are securely in place.

Obviously many modifications and variations of the present invention are possible in the light of the above teachings. It is therefore to be understood that within the scope of the appended claims the invention may be practiced otherwise than as specifically described.

I claim:

1. An apparatus for releasing a pretensioned band holding successive stages of a missile together comprising:

means secured to one end of the pretensioned band for provided at least one lug member having an inclined surface;

means secured to the other end of the pretensioned band for retaining the lug member in a retaining recess having an inclined wall configured to accommodate the inclined surface of the lug, the inclined surface and the inclined wall mechanically cooperating to produce a resultant force on and displacement of the lug from the retaining means;

means having a pair of cone-shaped cavities and carried on the providing means and the retaining means for holding the lug in the retaining recess, the holding means prevents displacement of the lug from the retaining recess;

means coupled to the cavities of the holding means for releasably securing the holding means on the providing means and the retaining means by the divergent displacement thereof;

means disposed in the retaining means for initiating a convergent displacement of the releasably securing means to release the holding means that enables the resultant force to push the holding means away and the consequent displacement of the lug and release of the pretensioned band.

2. An apparatus according to claim 1 in which a pair of lugs each integrally extending from a central portion and both have inclined surfaces and the retaining recess has a pair of inclined walls to accommodate the inclined surfaces of the lugs.

3. An apparatus according to claim 2 in which the retaining means is provided with a longitudinal bore and the initiating means includes a piston sized to longitudinally traverse the bore from a first position to a second position when a further included power cartridge is detonated.

4. An apparatus according to claim 3 in which the retaining means is further provided with a pair of aligned holes on diametrically opposed sides of the longitudinal bore and the releasably securing means is a pair of ball bearings each disposed in a separate hole in the retaining means and each extending into a separate cone-shaped cavity in the holding means when the piston is in the first position and each disposed in a separate hole and a portion of the longitudinal bore when the piston is traversed to the second position.

5. An apparatus according to claim 4 further including:

the piston is provided with an appropriate groove; and a retaining pin extending through the retaining means and into the longitudinal bore to engage the appropriate groove in the piston when the piston is in the first position to prevent premature release by shock and vibration during missile launch, the retaining pin is selected from a material to shear to permit release of the pretensioned band when the power cartridge is detonated.

6. An apparatus according to claim 5 in which the piston is further provided with another appropriate groove containing an O-ring to prevent moisture from corroding the bore and to prevent blowby from the power cartridge and to assure the releasing of the pretensioned band and the aligned holes each have an O-ring to resist corrosion.

7. An apparatus according to claim 6 in which the retaining means is provided with a threaded receptacle section at one end of the longitudinal bore configured to mate with corresponding threads on the power cartridge to enable attachment of the power cartridge after assembly of the rest of the apparatus to reduce hazards to attending personnel.

8. An apparatus according to claim 7 in which the retaining means is machined from a single block of material and welded to one end of the pretensioned band to assure structural integrity and to reduce turbulance.

9. An apparatus according to claim 8 in which the providing means is machined from a first portioned welded to the pretensioned band a second portion has the lug and an interconnecting threaded member coupling them together to provide for adjustment of band tension during assembly.

10. An apparatus according to claim 9 in which the interconnecting threaded member has a threaded bolt for adjusting the tension on the band.

* * * * *